US009507311B2

(12) United States Patent
Sone

(10) Patent No.: US 9,507,311 B2
(45) Date of Patent: Nov. 29, 2016

(54) IMAGE FORMING APPARATUS AND CLEANING METHOD

(71) Applicant: Sony Corporation, Tokyo (JP)

(72) Inventor: Masakazu Sone, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 14/338,801

(22) Filed: Jul. 23, 2014

(65) Prior Publication Data

US 2015/0037079 A1 Feb. 5, 2015

(30) Foreign Application Priority Data

Jul. 30, 2013 (JP) ..... 2013-158049

(51) Int. Cl.

| | |
|---|---|
| ***G03G 21/00*** | (2006.01) |
| ***B41J 35/00*** | (2006.01) |
| ***B65H 1/14*** | (2006.01) |
| ***B65H 1/26*** | (2006.01) |
| ***B65H 3/06*** | (2006.01) |

(52) U.S. Cl.

CPC ..... *G03G 21/00* (2013.01); *B41J 35/00* (2013.01); *B65H 1/14* (2013.01); *B65H 1/266* (2013.01); *B65H 3/06* (2013.01); *B65H 2301/531* (2013.01); *B65H 2405/115* (2013.01); *B65H 2405/1117* (2013.01); *B65H 2405/3322* (2013.01); *B65H 2511/515* (2013.01); *B65H 2801/12* (2013.01)

(58) Field of Classification Search

CPC ..... G03G 21/00
USPC ..... 399/123
See application file for complete search history.

(56) References Cited

U.S. PATENT DOCUMENTS

| | | | | |
|---|---|---|---|---|
| 4,579,328 | A * | 4/1986 | Hagihara | B65H 1/04 271/119 |
| 4,843,436 | A * | 6/1989 | Evangelista | G03G 15/6502 15/256.51 |
| 5,616,386 | A * | 4/1997 | Okada | G03G 15/6511 15/256.51 |
| 5,896,157 | A * | 4/1999 | Fisher, Sr. | B41J 29/17 15/118 |
| 8,177,444 | B2 * | 5/2012 | Wincent | B26D 5/14 400/611 |
| 8,244,156 | B2 * | 8/2012 | Iwamoto | G03G 15/0817 399/123 |
| 8,360,415 | B1 * | 1/2013 | Herrmann | B65H 3/06 271/109 |
| 8,777,215 | B2 * | 7/2014 | Ohkura | B65H 3/06 271/157 |
| 2009/0003906 | A1 * | 1/2009 | Takeuchi | B65H 1/26 399/357 |
| 2011/0188097 | A1 * | 8/2011 | Asada | H04N 1/04 358/498 |
| 2013/0139847 | A1 * | 6/2013 | Moore | B08B 1/00 134/6 |

FOREIGN PATENT DOCUMENTS

| | | | | |
|---|---|---|---|---|
| JP | 2003-176049 | A | 6/2003 | |
| JP | 200651552 | A * | 6/2006 | B65H 5/00 |

* cited by examiner

*Primary Examiner* — Anthony Nguyen
(74) *Attorney, Agent, or Firm* — Sheridan Ross P.C.

(57) ABSTRACT

There is provided an image forming apparatus including a paper feed tray configured to accommodate at least one sheet, a paper feed roller configured to send the sheet from the paper feed tray, and a cleaning member at the paper feed tray, the cleaning member being configured to clean a surface of the paper feed roller. The paper feed tray is movable between a paper feeding position from which the paper feed roller sends the sheet and a cleaning position at which the paper feed roller comes into contact with the cleaning member.

14 Claims, 8 Drawing Sheets

IMAGE FORMING APPARATUS AND CLEANING METHOD

CROSS REFERENCE TO RELATED APPLICATIONS

This application claims the benefit of Japanese Priority Patent Application JP 2013-158049 filed Jul. 30, 2013, the entire contents of which are incorporated herein by reference.

BACKGROUND

The present disclosure relates to an image forming apparatus and a cleaning method.

Image forming apparatuses such as printers and copiers include multiple rollers for moving, inside the image forming apparatuses, sheets on which images are recorded, feed and output the sheets and print on the sheets. Paper feed rollers send sheets from paper trays in which sheets are accommodated, and the paper feed rollers are first to come into contact with the accommodated sheets. Accordingly, paper powder and dust on the sheet surface adhere to the surfaces of the paper feed rollers and sometimes lower a coefficient of friction on the surfaces. The lowered coefficient of friction on the surfaces of the paper feed rollers cause a paper feeding malfunction. The paper feed rollers of the image forming apparatuses therefore have to be cleaned.

For example, JP 2003-176049A discloses a method of absorbing and cleaning off paper powder and dust adhering to a pickup roller and the like by setting a cleaning sheet at a paper feeding position and conveying the cleaning sheet, the cleaning sheet having an adhesive part and a non-adhesive part.

SUMMARY

JP 2003-176049A, however, bothers users about cleaning because the users each have to put a cleaning sheet at a predetermined position on the printer to start cleaning. This prevents users from regular cleaning so that paper powder and dust adhere to the paper feed roller, which sometimes causes a paper feeding malfunction.

In view of the circumstances described above, the present disclosure proposes a novel and improved image forming apparatus and cleaning method that allow a paper feed roller to be automatically cleaned.

According to an embodiment of the present disclosure, there is provided an image forming apparatus including a paper feed tray configured to accommodate at least one sheet, a paper feed roller configured to send the sheet from the paper feed tray, and a cleaning member at the paper feed tray, the cleaning member being configured to clean a surface of the paper feed roller. The paper feed tray is movable between a paper feeding position from which the paper feed roller sends the sheet and a cleaning position at which the paper feed roller comes into contact with the cleaning member.

According to another embodiment of the present disclosure, there is provided a cleaning method including moving a paper feed tray in an image forming apparatus from a paper feeding position, from which a paper feed roller sends a sheet, to a cleaning position, at which a cleaning member comes into contact with the paper feed roller, the cleaning member cleaning a surface of the paper feed roller, and cleaning a surface of the paper feed roller with the cleaning member in contact with the paper feed roller by rotating the paper feed roller at the cleaning position.

According to still another embodiment of the present disclosure, the moved paper feed tray allows the paper feed roller and the cleaning member to come into contact with or to be separated from each other. If the paper feed roller rotates in contact with the cleaning member, the paper feed roller can be cleaned.

According to one or more of embodiments of the present disclosure, the paper feed roller can be automatically cleaned.

The above-mentioned effects are not necessarily limited, but any effect shown in the present disclosure or any other effects that may be grasped herein may also be attained in addition to the above-mentioned effects or instead of the above-mentioned effects.

DETAILED DESCRIPTION OF THE EMBODIMENT(S)

Figure 1:
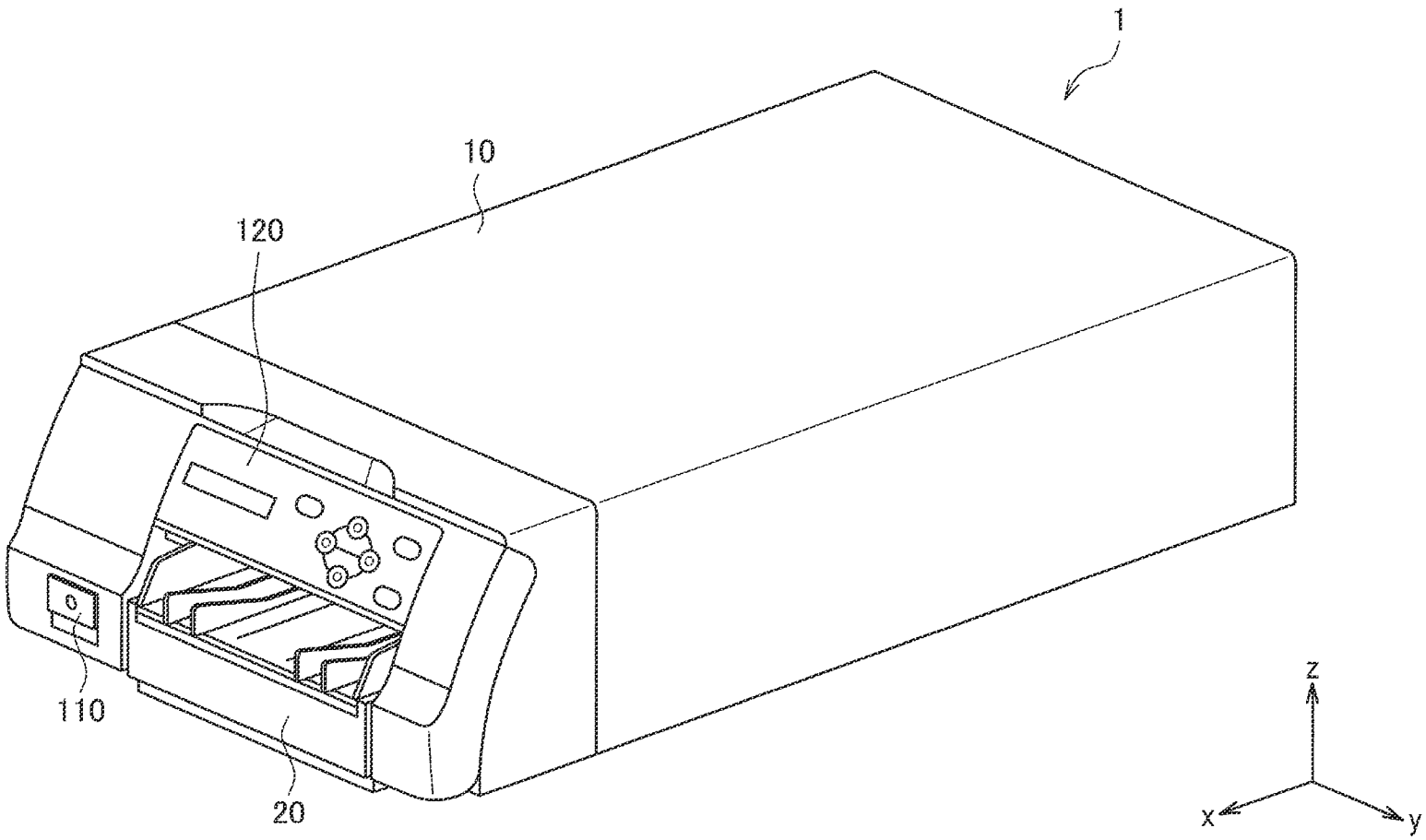
FIG. 1 is an overall perspective view illustrating an image forming apparatus according to an embodiment of the present disclosure.

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted.

The description will be made in the following order.

1. Configuration and Operation of Image Forming Apparatus according to Embodiment of Present Disclosure
2. State of Paper Feed Tray while Image Forming Apparatus Is Feeding Sheet
3. Automatic Cleaning of Image Forming Apparatus
4. Ejection of Paper Feed Tray of Image Forming Apparatus
5. Conclusion 1. Configuration and Operation of Image Forming Apparatus According to Embodiment of Present Disclosure The configuration and the operation of an image forming apparatus 1 according to an embodiment of the present disclosure will be now described with reference to FIGS. 1 to 4.

FIG. 1 is an overall perspective view illustrating an image forming apparatus 1 according to an embodiment of the present disclosure. The image forming apparatus 1 according to the present embodiment prints data on a target, the data being input from devices such as computers and digital cameras that are connected to the image forming apparatus 1. Examples of the image forming apparatus 1 include a printer and a copier. The image forming apparatus 1 illustrated in FIG. 1 is a thermal transfer printer that transfers inks applied on tapes to sheets. Although the image forming apparatus 1 will be described as a thermal transfer printer in the present embodiment, the present disclosure is not limited thereto. Thermal printers, ink-jet printers, and dry electrophotographic printers and copiers may also be adopted. As illustrated in FIG. 1, the image forming apparatus 1 includes, for example, a main body 10 and a paper feed tray 20.

The main body 10 includes, for example, a printing unit that prints data on sheets accommodated in the paper feed tray 20, a power switch 110 for the image forming apparatus 1 and an operation section 120 on which an operation button and an operation panel are installed, but the printing unit is not shown in the drawings.

The paper feed tray 20 accommodates sheets on which images are printed. The paper feed tray 20 is configured to be detachable from the main body 10 by an alternate mechanism. Pushed into the main body 10, the paper feed tray 20 can be moved in the x-axial direction so that the paper feed tray 20 can be fixed to and detached from the main body 10.

Figure 2:
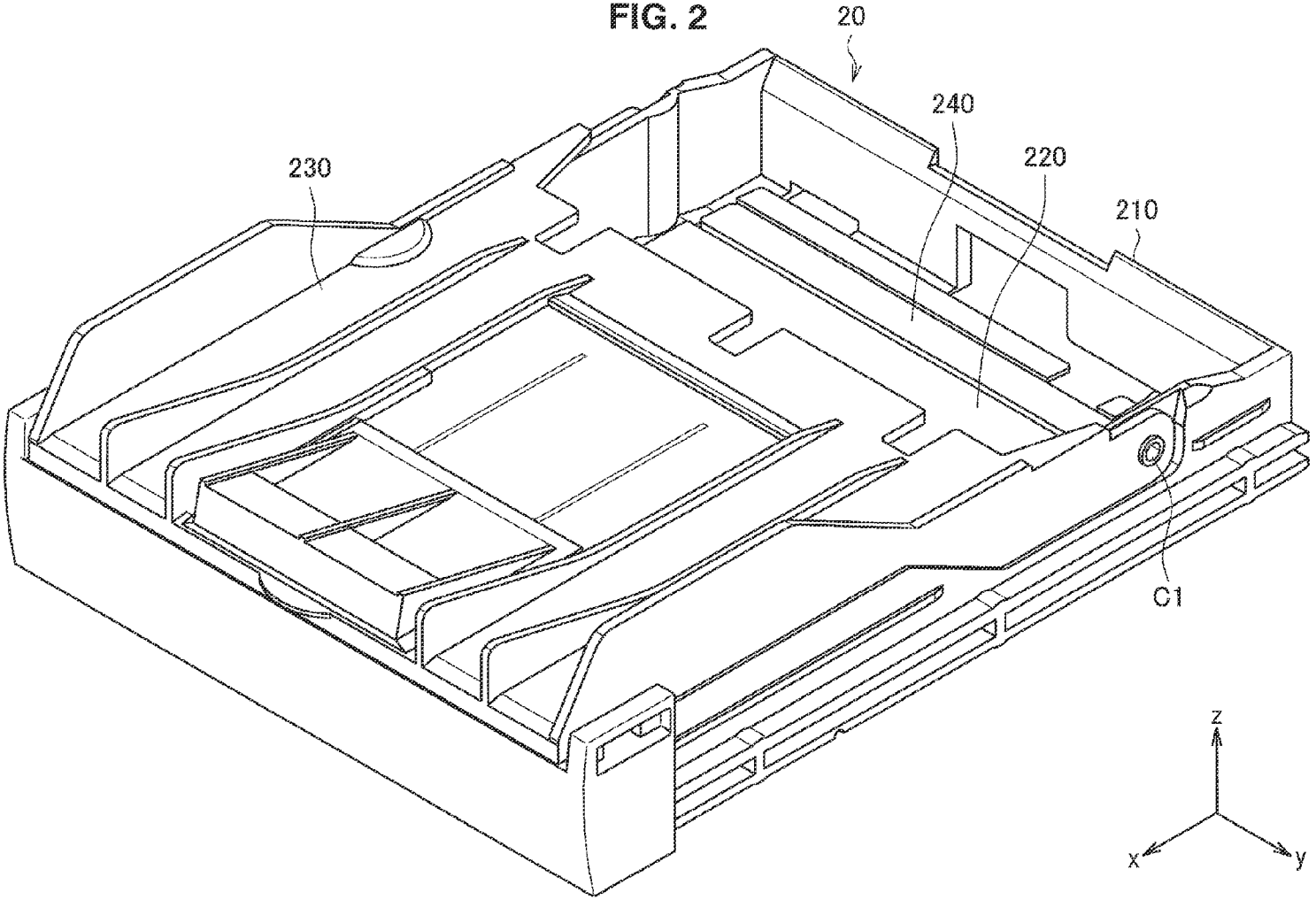
FIG. 2 is an overall perspective view illustrating a paper feed tray of the image forming apparatus according to the embodiment.

FIG. 2 is an overall perspective view illustrating the paper feed tray 20 of the image forming apparatus 1 according to the present embodiment. As illustrated in FIG. 2, the paper feed tray 20 includes, for example, an outer frame 210, a bottom surface 220 and a printed paper accommodating section 230. The bottom surface 220 is a placement surface on which sheets prior to printing are placed. The printed paper accommodating section 230 is rotatably installed on the outer frame 210 with a center C1 used as the rotational center. If the paper feed tray 20 rotates the printed paper accommodating section 230 substantially parallel with the bottom surface 220 as illustrated in FIG. 2, an opening is made on the paper feed tray 20 in the positive direction of the x-axis. Sheets are inserted from the opening of the paper feed tray 20 20 to be fed into the paper feed tray 20.

The bottom surface 220 includes a cleaning member 240 for cleaning a paper feed roller 30 discussed below. The bottom surface 220 is pressed from a paper lifter 60 discussed below in the positive direction of the z-axis to be moved in the z-axial direction. The cleaning member 240 is installed near the end of the bottom surface 220 in the negative direction of the x-axis and extends in the y-axial direction such that the cleaning member 240 comes into contact with a flat section 310 of the paper feed roller 30 discussed below when the bottom surface 220 is moved in the positive direction of the z-axis. In addition, the cleaning member 240 is made of a material such as foamed urethane and comes into contact with the paper feed roller 30 to clean the surface of the paper feed roller 30, to which paper powder and dust have adhered.

Figure 3:
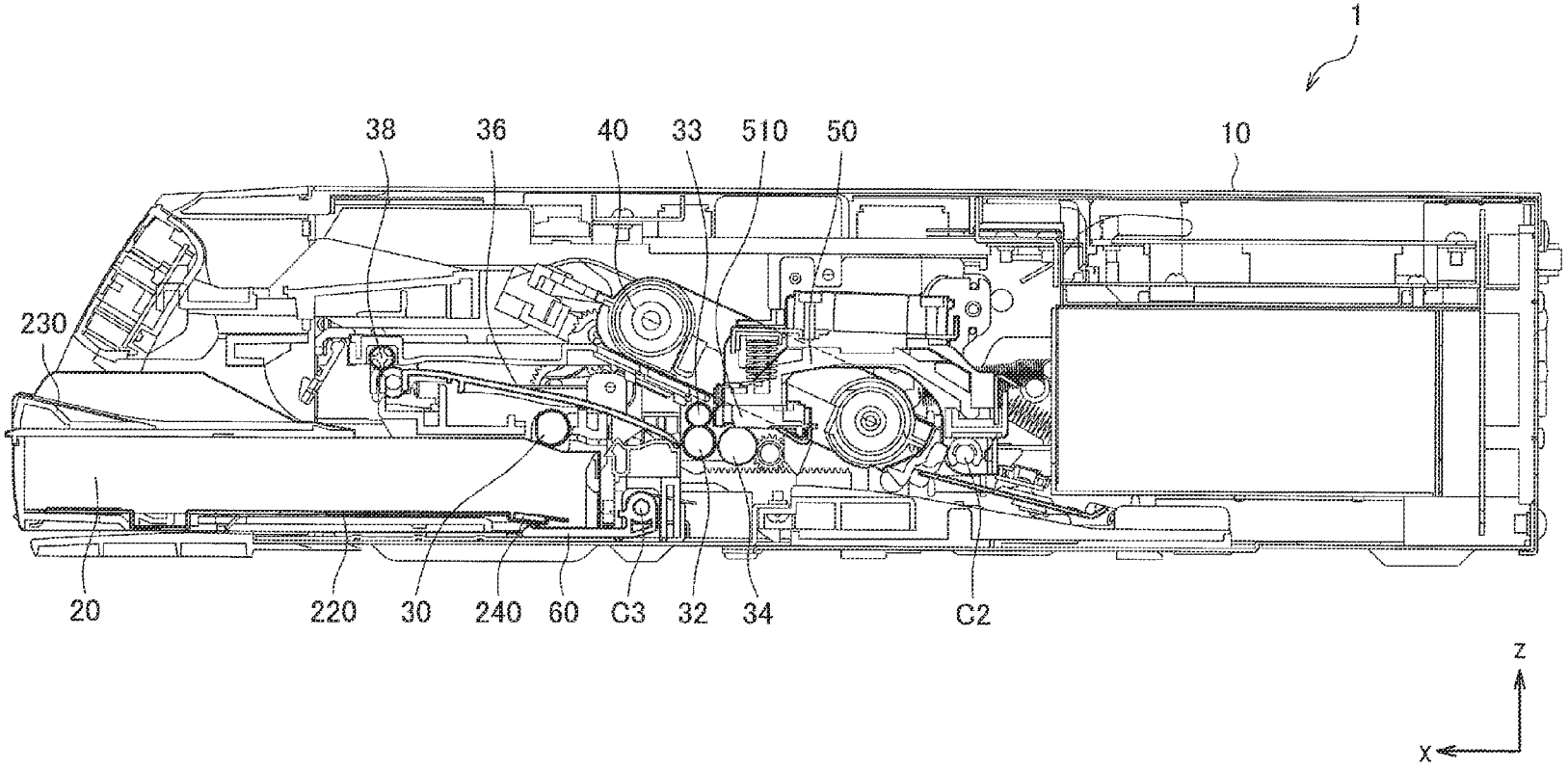
FIG. 3 is a transverse cross-sectional view illustrating the image forming apparatus according to the embodiment, which is in non-operation.

FIG. 3 is a transverse cross-sectional view illustrating the image forming apparatus 1 according to the present embodiment, which is in non-operation. The state of non-operation according to the present embodiment means, for example, that the image forming apparatus 1 is off.

The printing unit installed on the main body 10 of the image forming apparatus 1 includes, for example, a paper feed roller 30, a capstan roller 32, a pinch roller 33, a platen roller 34, a paper output flap 36 and a paper output roller 38. The printing unit also includes a ribbon 40, a thermal head 50 and a paper lifter 60.

The paper feed roller 30 comes into contact with a sheet accommodated in the paper feed tray 20, is rotated by a driving source, which is not shown in the drawings, and sends the sheet. The surface of the paper feed roller 30 is made of a material such as silicon, chloroprene rubber, styrene-butadiene rubber, urethane rubber and ethylene-propylene rubber that has a high coefficient of friction and offers great resistance to abrasion. The paper feed roller 30 is the first roller that comes into contact with a sheet accommodated in the paper feed tray 20. Accordingly, paper powder and dust on the sheet surface adhere to the surface of the paper feed roller 30 and sometimes lower a coefficient of friction on the surface. Dust that has entered the image forming apparatus 1 also adheres to the paper feed roller and sometimes lowers a coefficient of friction on the surface.

The capstan roller 32 is rotated by a driving source, which is not shown in the drawings. The pinch roller 33 is rotated by friction generated upon contact with the capstan roller 32. A sheet sent from the paper feed roller 30 is sent to between the capstan roller 32 and the pinch roller 33. The sheet is sent to the platen roller 34, which prints on the sheet, by friction between the capstan roller 32 and the sheet. The capstan roller 32 is rotated in the opposite direction to a direction in which the capstan roller 32 feeds a sheet. Accordingly, the capstan roller 32 can also send a sheet in the paper outputting direction opposite to the paper feeding direction, in which a sheet is sent during paper feeding.

The platen roller 34 receives the pressure exerted from the thermal head 50 and helps print an image onto a sheet discussed below.

In order to output the printed sheet, the paper output flap 36 guides, to the paper output roller 38, the printed sheet that has been sent from the capstan roller 32.

The sheet that has been sent from the capstan roller 32 is sent by the paper output roller 38 via the paper output flap 36 to the printed paper accommodating section 230.

The ribbon 40 is an ink cartridge having at least one-color sublimation ink applied onto the surface. The ink is sublimated by heat generated from the thermal head 50 pressed by the ribbon 40, and the sublimated ink is transferred onto a sheet to form an image on the sheet. A coating material with which the printing surface of a sheet is to be coated may be further applied onto the surface of the ribbon 40 in addition to the sublimation ink.

The thermal head 50 is configured to be rotatable around a center C2 extending in the y-axial direction as the rotational center. The thermal head 50 is rotated around the center C2 as the rotational center by a driving section, which is not shown in the drawings. The thermal head 50 can hereby press a roller contact section 510 to the platen roller 34. The thermal head 50 presses the ribbon 40 and a sheet to the platen roller 34 with both the ribbon 40 and the sheet kept between the roller contact section 510 of the thermal head 50 and the platen roller 34, and an image is consequently printed. Multiple heating elements are disposed on the roller contact section 510 in the y-axial direction. The image forming apparatus 1 causes the heating elements to emit heat to transfer a sublimation ink applied onto the ribbon 40 to a sheet so that an image is printed. The temperatures of heat emitted by the heating elements are controlled for each heating element. This allows the sublimation ink to be transferred onto a sheet in desired depth and shapes.

The paper lifter 60 is configured to be rotatable around a center C3 extending in the y-axial direction as the rotational center. The paper lifter 60 is rotated by a driving section, which is not shown in the drawings, and the end of the paper lifter 60 in the negative direction of the x-axis rises in the positive direction of the z-axis. Accordingly, the bottom surface 220 of the paper feed tray 20 is lifted in the positive direction of the z-axis. This allows a sheet placed on the bottom surface 220 to come into contact with the paper feed roller 30 regardless of an amount of the sheets that are accommodated in the paper feed tray 20. Sheets are therefore smoothly fed. Additionally, one end of the paper lifter 60 has been rising in the positive direction of the z-axis and has been lifting the bottom surface 220 in the positive direction of the x-axis at least during paper feeding and cleaning.

Figure 4:
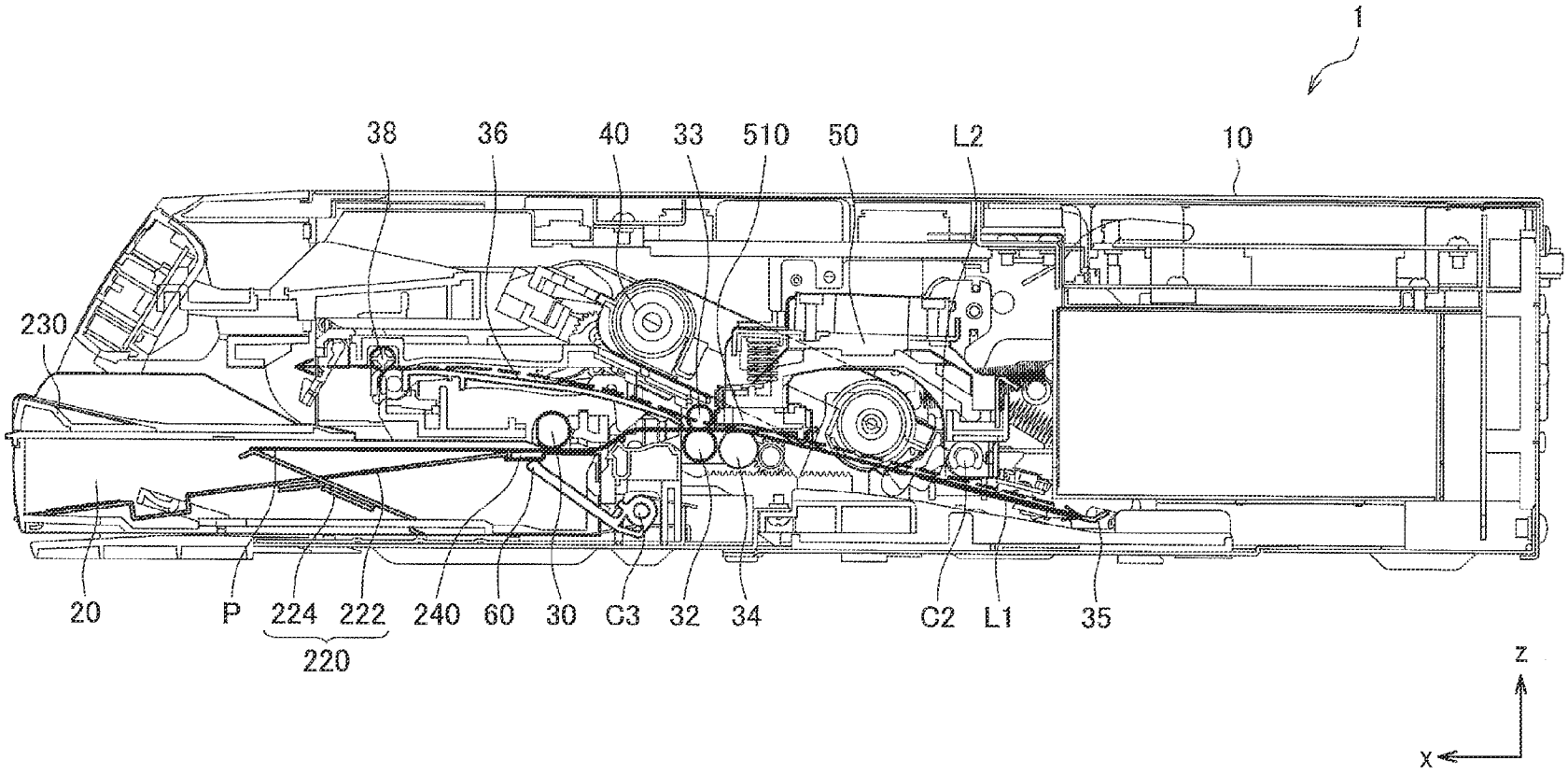
FIG. 4 is an explanatory diagram illustrating a paper feed path and a paper output path of the image forming apparatus according to the embodiment.
Figure 5:
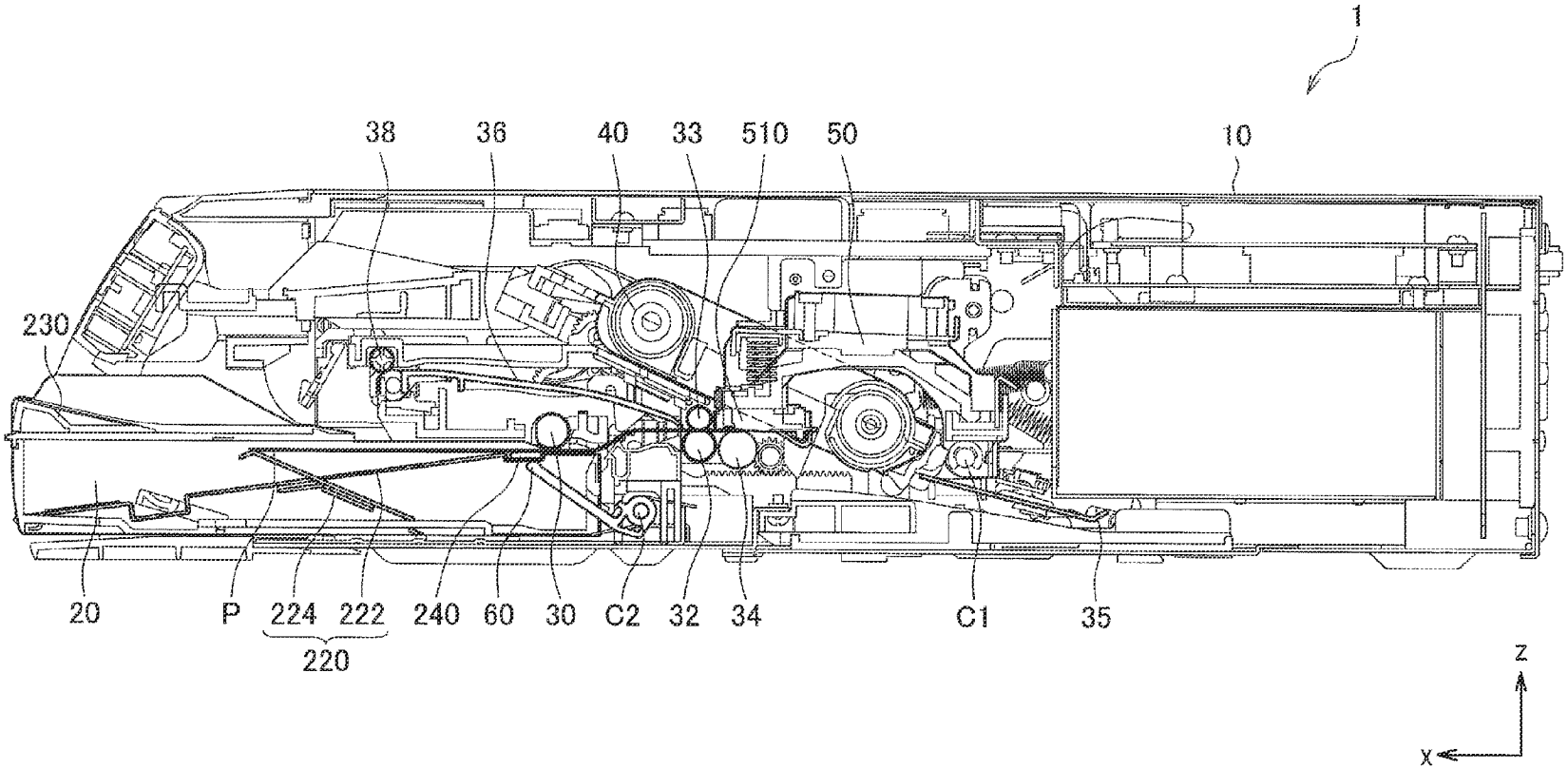
FIG. 5 is a transverse cross-sectional view illustrating the image forming apparatus according to the embodiment, which is feeding a sheet.

FIG. 4 is an explanatory diagram illustrating a paper feed path and a paper output path of the image forming apparatus 1 according to the present embodiment. FIG. 4, and FIG. 5 discussed below illustrate states of the image forming apparatus 1 according to the present embodiment, which is feeding sheets. Compared with the image forming apparatus 1 in non-operation as illustrated in FIG. 3, the paper feed tray 20 accommodates multiple sheets P in the state of the image forming apparatus 1 illustrated in FIG. 4. The paper lifter 60 rises in the positive direction of the z-axis, and the rise of the paper lifter 60 lifts the bottom surface 220 to the paper feed roller 30 in the state of the image forming apparatus 1 illustrated in FIG. 4.

A paper feed path L1 shows a path through which the sheets P accommodated in the paper feed tray 20 are moved to a position at which images are printed. A paper output path L2 shows a path through which the printed sheets P are ejected to the printed paper accommodating section 230.

The paper feed path L1 will be described with reference to FIG. 4. First of all, a sheet P placed on the top of the sheets P accommodated in the paper feed tray 20 is sent to the capstan roller 32 by the paper feed roller 30. The sheet P sent to the capstan roller 32 is then sent to the platen roller 34 by the capstan roller 32 and the pinch roller 33. The sheet P sent to the platen roller 34 is thereafter pressed to the platen roller 34 along with the ribbon 40 by the thermal head 50, and heat generated at the roller contact section 510 transfers an ink applied to the ribbon 40 so that an image is printed on the sheet P. Additionally, the capstan roller 32 and the pinch roller 33 keep sending the sheet P until an image has been printed in a predetermined printing area of the sheet P. The sheet P, which has been sent by the platen roller 34 and an image has been printed on, is sent to the paper feed flap 35.

Next, the paper output path L2 will be described with reference to FIG. 4. First of all, the printed sheet P is sent to the paper output roller 38 via the paper output flap 36 by the capstan roller 32 and the pinch roller 33. The capstan roller 32 then rotates in the opposite direction to the rotational direction of the capstan roller 32 in the paper feed path L1. The sheet P sent to the paper output roller 38 is ejected to the printed paper accommodating section 230 by the paper output roller 38.

Additionally, the image forming apparatus 1 according to the present embodiment prints an image more than once in a predetermined printing area of the sheet P if the image is printed in multiple colors or a coating material besides a sublimation ink is used for printing. The image forming apparatus 1 according to the present embodiment then switches the rotational directions of the capstan roller 32 and sends the sheet P such that the predetermined printing area of the sheet P passes the platen roller 34 more than once.

The configuration and the operation of the image forming apparatus 1 according the present embodiment have been described above. Next, the detailed description will be made with reference to FIG. 5 on a state of the paper feed tray 20 while the image forming apparatus 1 according to the present embodiment is feeding a sheet.

2. State of Paper Feed Tray While Image Forming Apparatus is Feeding Sheet

The image forming apparatus 1 according to the present embodiment feeds a sheet, for example, with the sheet P accommodated in the paper feed tray 20 and the power source of the image forming apparatus 1 kept on. FIG. 5 is a transverse cross-sectional view illustrating the image forming apparatus 1 according to the present embodiment, which is feeding a sheet.

As illustrated in FIG. 5, the bottom surface 220 includes a first bottom surface 222 and a second bottom surface 224. The second bottom surface 224 is installed at the center of the width direction and the longitudinal direction of the first bottom surface 222. The second bottom surface 224 is installed so as to be flush with the first bottom surface 222 when in non-operation as illustrated in FIG. 3. When the sheet P is accommodated in the paper feed tray 20, the first bottom surface 222 and the second bottom surface 224 rise in the positive direction of the z-axis from the non-operation position illustrated in FIG. 3 to the position for feeding a sheet as illustrated in FIG. 5 so that the accommodated sheet P is raised in the positive direction of the z-axis. The end of the paper lifter 60 in the positive direction of the x-axis raises the first bottom surface 222 in the positive direction of the z-axis, and then the end of the first bottom surface 222 in the negative direction of the x-axis is raised in the positive direction of the z-axis. The second bottom surface 224 is configured such that the end of the second bottom surface 224 in the positive direction of the x-axis is raised in the positive direction of the z-axis by the rise of the end of the first bottom surface 222. A sheet P on the top of the sheets P accommodated in the paper feed tray 20 comes into contact with the paper feed roller 30 when the sheets are fed as illustrated in FIG. 5, and the rotation of the paper feed roller 30 sends the sheet P to the capstan roller 32.

Paper feeding of the image forming apparatus 1 according to the present embodiment has been described above. Next, automatic cleaning of the image forming apparatus 1 according to the present embodiment will be described with reference to FIGS. 6 and 7.

3. Automatic Cleaning of Image Forming Apparatus

Figure 6:
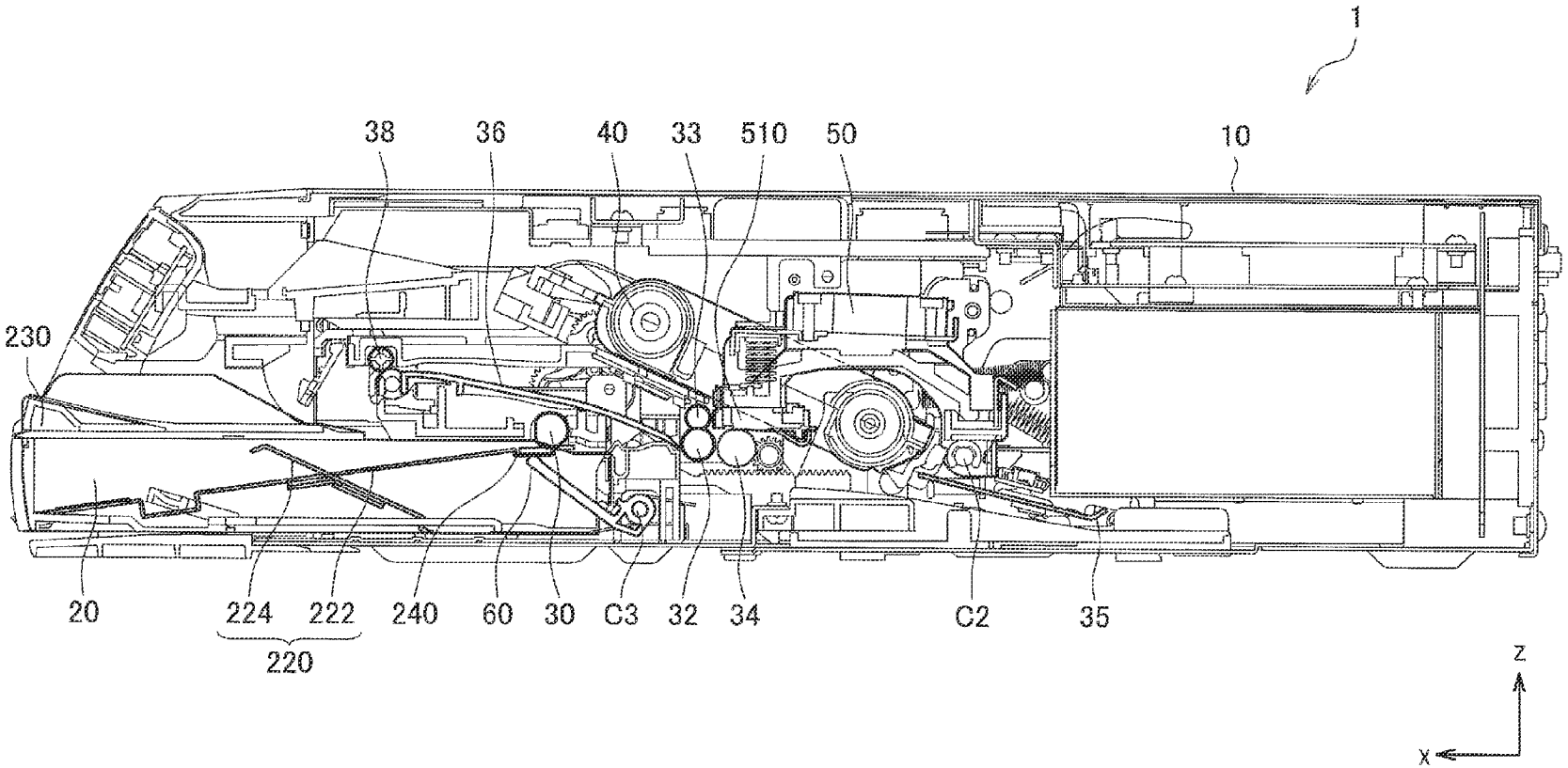
FIG. 6 is a transverse cross-sectional view illustrating the image forming apparatus according the embodiment, which is doing automatic cleaning.

The image forming apparatus 1 according to the present embodiment does automatic cleaning, for example, when the power source is on and all of the sheets P accommodated in the paper feed tray 20 run out. FIG. 6 is a transverse cross-sectional view illustrating the image forming apparatus 1 according to the present embodiment, which is doing automatic cleaning.

Compared with the image forming apparatus 1 feeding sheets as illustrated in FIG. 5, the image forming apparatus 1 illustrated in FIG. 6 has no sheets P in the paper feed tray 20, the paper feed tray 20 moves in the negative direction of the x-axis, and the bottom surface 220 and the paper lifter 60 move the sheets P in the positive direction of the z-axis. Additionally, a position of the paper feed tray 20 with respect to the main body 10 as illustrated in FIG. 4 will be referred to as a paper feeding position, while a position of the paper feed tray 20 with respect to the main body 10 as illustrated in FIG. 6 will be referred to as a cleaning position.

The paper feed tray 20 is moved between the paper feeding position and the cleaning position on the basis of an amount of the sheets P accommodated in the paper feed tray 20. Once the sheets P accommodated in the paper feed tray 20 run out, the image forming apparatus 1 moves the paper feed tray 20 from the paper feeding position to the cleaning position in the example illustrated in FIG. 6. This brings the cleaning member 240 into contact with the paper feed roller 30. The image forming apparatus 1 then rotates the paper feed roller 30 in contact with the cleaning member 240 to clean the surface of the paper feed roller 30.

Figure 7:
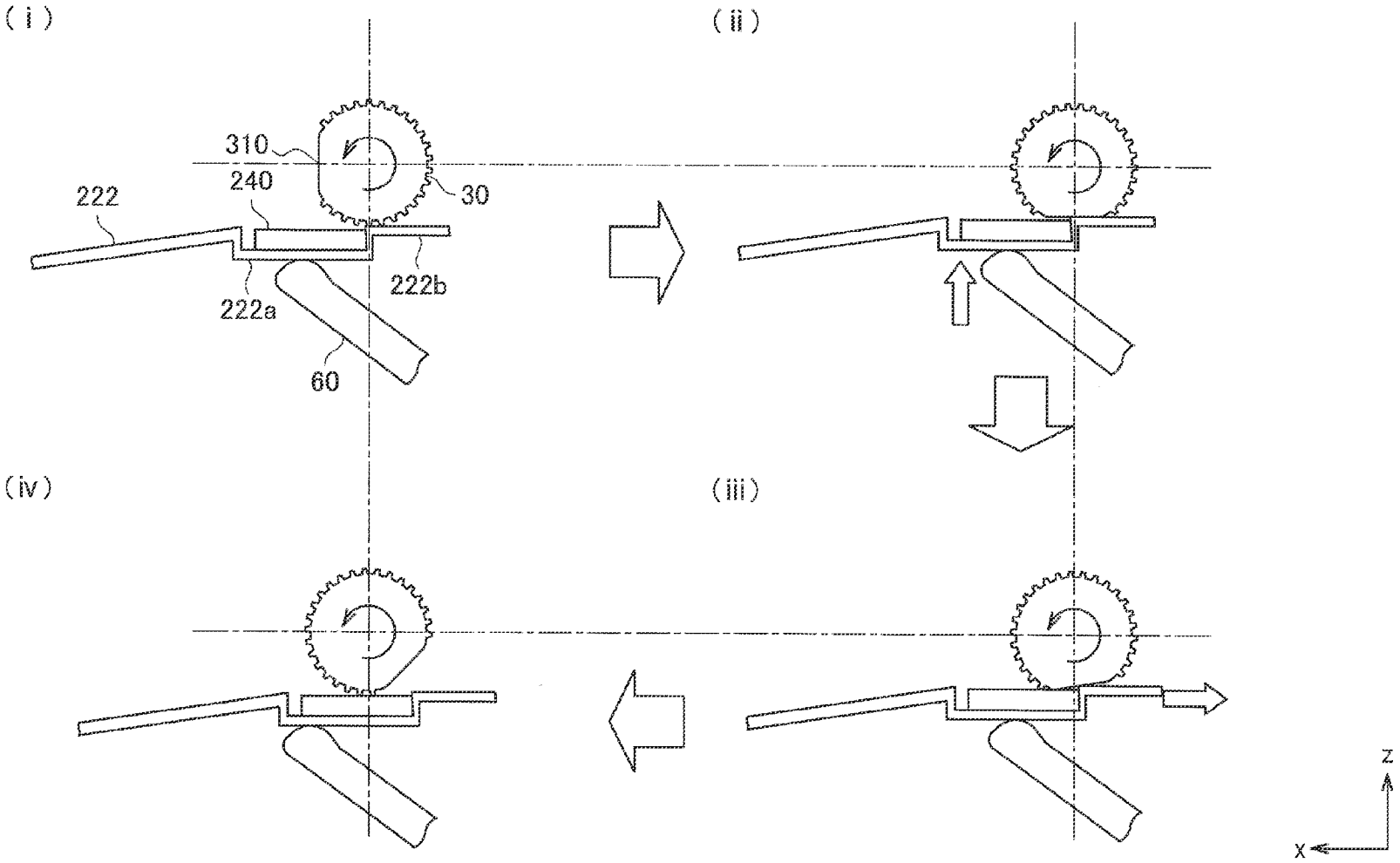
FIG. 7 is an explanatory diagram illustrating a mechanism for moving the paper feed tray of the image forming apparatus according to the embodiment from a paper feeding position to a cleaning position.

Next, the description will be made with reference to FIG. 7 on a mechanism for moving the paper feed tray 20 of the image forming apparatus 1 according to the present embodiment from the paper feeding position to the cleaning position. FIG. 7 is an explanatory diagram illustrating a mechanism for moving the paper feed tray 20 of the image forming apparatus 1 according to the present embodiment from the paper feeding position to the cleaning position.

FIG. 7 shows that a positional relationship between the paper feed roller 30 and the first bottom surface 222 and a positional relationship between the paper feed roller 30 and the cleaning member 240 are changing in order of states (i) to (iv). As illustrated in FIG. 7, the first bottom surface 222 includes, in the negative direction of the x-axis, a concave section 222*a*, at which the cleaning member 240 is installed, and a roller contact section 222*b*, which comes into contact with the paper feed roller 30. The concave section 222*a* extends in the y-axial direction, which is the sheet width direction of the first bottom surface 222. The paper feed roller 30 is formed in in a shape of a substantial cylinder that extends in the y-axial direction, and further includes a flat section 310 extending in the y-axial direction in a part of the cylindrical surface.

The paper feed tray 20 is located at the paper feeding position and the sheets P accommodated in the paper feed tray 20 have run out in the state (i). The first bottom surface 222 is pressed in the positive direction of the z-axis by the paper lifter 60 in the state (i) so that the paper feed roller 30 is brought into contact with the roller contact section 222*b* of the first bottom surface 222.

After the state (i), the paper feed roller 30 rotates to bring the flat section 310 into contact with the roller contact section 222*b* in the state (ii). The pressure from the paper lifter 60 moves the first bottom surface 222 in the positive direction of the z-axis when the first bottom surface 222 comes into contact with the flat section 310 of the paper feed roller 30.

After the state (ii), the paper feed roller 30 rotates to come into contact with the cleaning member 240 in the state (iii). Friction is generated between the paper feed roller 30 and the cleaning member 240. The friction generated between the paper feed roller 30 and the cleaning member 240, and the rotation of the paper feed roller 30 then move the paper feed tray 20 in the negative direction of the x-axis from the paper feeding position to the cleaning position.

After the state (iii), the paper feed roller 30 rotates to move the paper feed tray 20 to the cleaning position in the state (iv). The paper feed roller 30 is rotated by a driving section a predetermined number of times or for a predetermined time with the paper feed tray 20 kept at the cleaning position, at which the paper feed tray 20 has been located in the state (iv). The paper feed roller may rotate, for example, for 5 seconds after the paper feed tray 20 moves to the cleaning position. The paper feed roller 30 rotates keeping the surface in contact with the cleaning member 240 because the paper lifter 60 keeps pressing the first bottom surface 222 in the positive direction of the z-axis at least during automatic cleaning. A stopper, which is not shown in the drawings, is also installed for fixing the paper feed tray 20 at the cleaning position such that the paper feed tray 20 does not further move in the negative position of the x-axis from the cleaning position. Even if the paper feed roller 30 rotates in the state (iv), the cleaning member does not therefore move in the x-axial direction to allow the paper feed roller 30 to be reliably cleaned.

Additionally, a greater coefficient of friction between the cleaning member 240 and the paper feed roller 30 is designed than a coefficient of friction between the roller contact section 222*b* and the paper feed roller 30. That is, even though the paper feed roller 30 rotates in the state (i), the paper feed tray 20 is not moved because friction generated between the roller contact section 222*b* and the paper feed roller 30 is less than friction generated between the cleaning member 240 and the paper feed roller 30. To the contrary, the rotation of the paper feed roller 30 in the state (iii) moves the paper feed tray 20 to the cleaning position because friction generated between the cleaning member 240 and the paper feed roller 30 is greater than friction generated between the roller contact section 222*b* and the paper feed roller 30. When the sheets P is on the placement surface of the first bottom surface 222 in the positional relationship between the paper feed roller 30 and the first bottom surface 222 in the state (iii), the paper feed roller 30 does not come into contact with the cleaning member 240, and accordingly strong friction is not generated so that the paper feed tray 20 is not moved.

As illustrated in FIG. 7, the top face of the cleaning member 240 is arranged not to project over the top face of the roller contact section 222*b* in the positive direction of the z-axis. That is, the thickness of the cleaning member 240 in the z-axial direction of the placement surface, on which the sheets P are placed, is arranged to be equal to or less than the depth of the concave section 222*a*. This makes the sheets P less likely to come into contact with the cleaning member 240 during paper feeding, thereby allowing the sheets P to be smoothly sent.

The description has been made above on automatic cleaning of the image forming apparatus 1 according to the present embodiment. After the sheets P in the paper feed tray 20 run out, the image forming apparatus 1 according to the present embodiment moves the paper feed tray 20 from the paper feeding position to the cleaning position through the rotation of the paper feed roller 30, and causes the cleaning member 240 to automatically clean the surface of the paper feed roller 30. This allows cleaning of the paper feed roller 30, which bothers users, to be automatically done, and can prevent a paper feeding malfunction caused by paper powder and dust on the paper feed roller.

4. Ejection of Paper Feed Tray of Image Forming Apparatus

Figure 8:
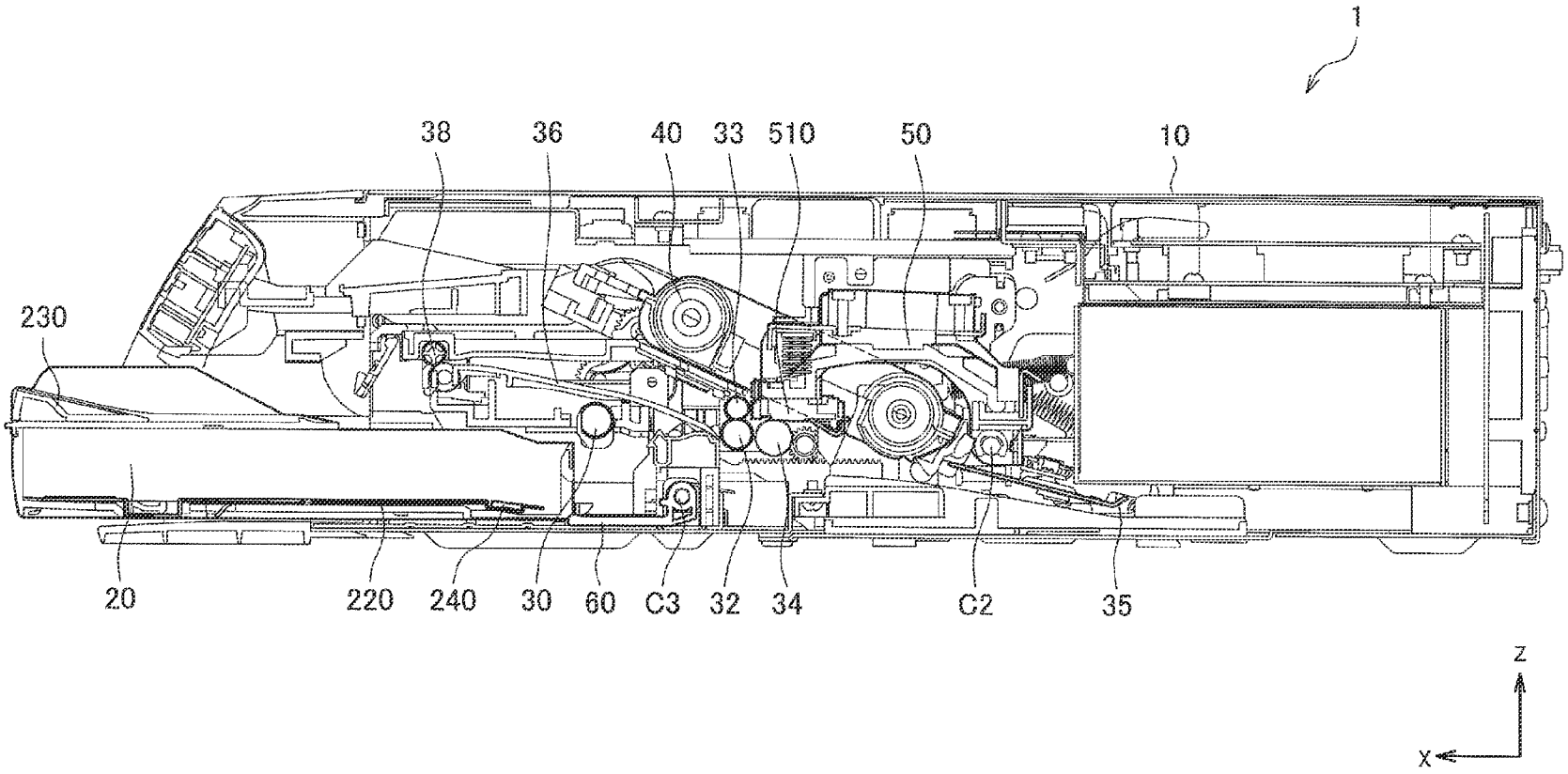
FIG. 8 is a transverse cross-sectional view illustrating the image forming apparatus according to the embodiment while the paper feed tray is being ejected.

Next, ejection of the paper feed tray of the image forming apparatus 1 according to the present embodiment will be described with reference to FIG. 8. FIG. 8 is a transverse cross-sectional view illustrating the image forming apparatus according to the present embodiment while the paper feed tray is being ejected. Compared with the image forming apparatus 1 in non-operation as illustrated in FIG. 3, the image forming apparatus 1 illustrated in FIG. 8 has the paper feed tray 20 moved in the positive direction of the x-axis.

The paper feed tray 20 is fixed to or detached from the main body 10 by the alternate mechanism. The movement of the paper feed tray 20 to the cleaning position thus releases the fixation of the main body 10 with the paper feed tray 20 in the image forming apparatus 1 according to the present embodiment. After the automatic cleaning, the rotation of the paper feed roller 30 begins to stop so that the paper feed tray 20 is automatically ejected.

Ejection of the paper feed tray of the image forming apparatus 1 according to the present embodiment has been described above. The image forming apparatus 1 according to the present embodiment has the paper feed tray automatically ejected, but the present disclosure is not limited thereto. For example, a user may manually eject the paper feed tray, or a driving section, which is not shown in the drawings, may also automatically eject the paper feed tray.

5. Conclusion

The image forming apparatus 1 according to the present embodiment has been described above. After the sheets P in the paper feed tray 20 run out, the image forming apparatus 1 according to the present embodiment moves the paper feed tray 20 from the paper feeding position to the cleaning position through the rotation of the paper feed tray 30, and causes the cleaning member 240 to automatically clean the surface of the paper feed roller 30. This allows cleaning of the paper feed roller 30, which bothers users, to be automatically done, and can prevent a paper feeding malfunction caused by paper powder and dust on the paper feed roller.

Although the preferred embodiments of the present disclosure have been described above in detail with reference to the appended drawings, the present disclosure is not limited thereto. It is obvious to those skilled in the art that various modifications or variations are possible insofar as they are within the technical scope of the appended claims or the equivalents thereof. It should be understood that such modifications or variations are also within the technical scope of the present disclosure.

It is assumed, for example, in the above-described embodiment that friction generated between the paper feed roller 30 and the cleaning member 240, and the rotation of the paper feed roller 30 move the paper feed tray 20 from the paper feeding position to the cleaning position, but the present disclosure is not limited thereto. For example, the height of the roller contact section 222*b* in the z-axial direction may be arranged to be greater than the placement surface of the cleaning member 240, and in the state (iii) illustrated in FIG. 7, the paper feed roller 30 may be engaged with an engaging section, which is a corner section of a step between the roller contact section 222*b* and the placement surface of the cleaning member 240. Engaged with the step, the paper feed roller 30 then rotates to move the paper feed tray 20 to the paper feeding position.

Furthermore, it is assumed in the above-described embodiment that friction generated between the paper feed roller 30 and the cleaning member 240, and the rotation of the paper feed roller 30 move the paper feed tray 20 from the paper feeding position to the cleaning position, but the present disclosure is not limited thereto. For example, there may be provided a sheet detecting section such as an infrared sensor that detects whether the paper feed tray 20 accommodates the sheets and there may also be provided a mechanism for moving the paper feed tray 20 to the cleaning position, when the sheet detecting section detects that the paper feed tray 20 runs out of the sheets P. For example, there may be provided an engaging section in at least one of the paper feed tray 20 and the main body 10, the engaging section being configured to engage the paper feed tray 20 with the main body 10. In this case, a mechanism in which a driving section moves the paper feed tray 20 engaged with the main body 10 with respect to the main body 10 to the cleaning position, moves the paper feed tray 20. The mechanism for moving the paper feed tray 20 to the cleaning position may also provide a gear on the same shaft of the paper feed roller 30 and may move the gear with a driving section to move the paper feed tray 20. The mechanism for moving the paper feed tray 20 to the cleaning position allows the paper feed tray 20 to more reliably move to the cleaning position. Additionally, if such a mechanism is installed, the paper feed roller 30 may be formed in a shape of a substantial cylinder that does not have the flat section 310 because the paper feed tray 20 can be moved regardless of the shape of the paper feed roller 30.

The effects described herein are merely explanatory and illustrative, and not limited. The technology according to the embodiment of the present disclosure attains other effects obvious to those skilled in the art in addition to the above-described effects or instead thereof.

Additionally, the present technology may also be configured as below.

(1) An image forming apparatus including:
- a paper feed tray configured to accommodate at least one sheet;
- a paper feed roller configured to send the sheet from the paper feed tray; and
- a cleaning member at the paper feed tray, the cleaning member being configured to clean a surface of the paper feed roller,
- wherein the paper feed tray is movable between a paper feeding position from which the paper feed roller sends the sheet and a cleaning position at which the paper feed roller comes into contact with the cleaning member.

(2) The image forming apparatus according to (1),
- wherein the paper feed tray is moved between the paper feeding position and the cleaning position on the basis of an amount of the sheets accommodated in the paper feed tray.

(3) The image forming apparatus according to (1) or (2),
- wherein the paper feed tray is located at the paper feeding position when the sheet is accommodated in the paper feed tray, while the paper feed tray is located at the cleaning position when the sheet is not accommodated in the paper feed tray.

(4) The image forming apparatus according to any one of (1) to (3),
- wherein the paper feed tray is moved from the paper feeding position to the cleaning position when the paper feed tray runs out of the sheets.

(5) The image forming apparatus according to any one of (1) to (4),
- wherein the cleaning member is installed on a placement surface on which the sheet is placed.

(6) The image forming apparatus according to any one of (1) to (5), wherein the cleaning member cleans a surface of the paper feed roller through rotation of the paper feed roller in contact with the cleaning member.

(7) The image forming apparatus according to any one of (1) to (6), further including:

a paper lifter configured to press the sheet accommodated in the paper feed tray to the paper feed roller.

(8) The image forming apparatus according to any one of (1) to (7), wherein the cleaning member comes into contact with the paper feed roller when all of the sheets accommodated in the paper feed tray run out, and wherein rotation of the paper feed roller and friction generated between the paper feed roller and the cleaning member move the paper feed tray from the paper feeding position to the cleaning position.

(9) The image forming apparatus according to any one of (1) to (7), wherein the paper feed tray further includes an engaging section that engages the paper feed roller, wherein the engaging section engages with the paper feed roller when all of the sheets accommodated in the paper feed tray run out, and wherein rotation of the paper feed roller engaged with the engaging section moves the paper feed tray from the paper feeding position to the cleaning position.

(10) The image forming apparatus according to any one of (1) to (7), further including:

a sheet detecting section configured to detect that all of the sheets accommodated in the paper feed tray run out; and a driving section configured to move the paper feed tray from the paper feeding position to the cleaning position on the basis of a detection result of the sheet detecting section.

(11) The image forming apparatus according to any one of (1) to (10), wherein a coefficient of friction between the cleaning member and the paper feed roller is greater than a coefficient of friction between the cleaning member and a placement surface of the paper feed tray for the sheet.

(12) The image forming apparatus according to any one of (1) to (11), wherein the paper feed roller is formed in a shape of a cylinder, and further includes a flat section on a part of a surface of the cylinder.

(13) The image forming apparatus according to any one of (1) to (12), wherein a surface on which the cleaning member comes into contact with the paper feed roller is arranged not to project over a placement surface of the paper feed tray for the sheet.

(14) A cleaning method including:

moving a paper feed tray in an image forming apparatus from a paper feeding position, from which a paper feed roller sends a sheet, to a cleaning position, at which a cleaning member comes into contact with the paper feed roller, the cleaning member cleaning a surface of the paper feed roller; and cleaning the surface of the paper feed roller with the cleaning member by rotating the paper feed roller at the cleaning position.

What is claimed is:

1. An image forming apparatus comprising:

a paper feed tray configured to accommodate at least one sheet;

a paper feed roller configured to send the sheet from the paper feed tray; and a cleaning member within a groove formed in a bottom surface of the paper feed tray, the cleaning member being configured to clean a surface of the paper feed roller, wherein the paper feed tray is movable between a paper feeding position from which the paper feed roller sends the sheet and a cleaning position at which the paper feed roller comes into contact with the cleaning member.

2. The image forming apparatus according to claim 1, wherein the paper feed tray is moved between the paper feeding position and the cleaning position on the basis of an amount of the sheets accommodated in the paper feed tray.

3. The image forming apparatus according to claim 1, wherein the paper feed tray is located at the paper feeding position when the sheet is accommodated in the paper feed tray, while the paper feed tray is located at the cleaning position when the sheet is not accommodated in the paper feed tray.

4. The image forming apparatus according to claim 1, wherein the paper feed tray is moved from the paper feeding position to the cleaning position when the paper feed tray runs out of the sheets.

5. The image forming apparatus according to claim 1, wherein the cleaning member is installed on a placement surface on which the sheet is placed.

6. The image forming apparatus according to claim 1, wherein the cleaning member cleans a surface of the paper feed roller through rotation of the paper feed roller in contact with the cleaning member.

7. The image forming apparatus according to claim 1, further comprising:

a paper lifter configured to press the sheet accommodated in the paper feed tray to the paper feed roller.

8. The image forming apparatus according to claim 1, wherein the cleaning member comes into contact with the paper feed roller when all of the sheets accommodated in the paper feed tray run out, and wherein rotation of the paper feed roller and friction generated between the paper feed roller and the cleaning member move the paper feed tray from the paper feeding position to the cleaning position.

9. The image forming apparatus according to claim 1, wherein the paper feed tray further includes an engaging section that engages the paper feed roller, wherein the engaging section engages with the paper feed roller when all of the sheets accommodated in the paper feed tray run out, and wherein rotation of the paper feed roller engaged with the engaging section moves the paper feed tray from the paper feeding position to the cleaning position.

10. The image forming apparatus according to claim 1, wherein a coefficient of friction between the cleaning member and the paper feed roller is greater than a coefficient of friction between the cleaning member and a placement surface of the paper feed tray for the sheet.

11. The image forming apparatus according to claim 1, wherein the paper feed roller is formed in a shape of a cylinder, and further includes a flat section on a part of a surface of the cylinder.

12. The image forming apparatus according to claim 1, wherein a surface on which the cleaning member comes into contact with the paper feed roller is arranged not to project over a placement surface of the paper feed tray for the sheet.

13. A cleaning method comprising:

moving a paper feed tray in an image forming apparatus from a paper feeding position, from which a paper feed roller sends a sheet, to a cleaning position, at which a cleaning member comes into contact with the paper feed roller, the cleaning member being within a groove formed in a bottom surface of the paper feed tray, the cleaning member cleaning a surface of the paper feed roller; and cleaning the surface of the paper feed roller with the cleaning member by rotating the paper feed roller at the cleaning position.

14. The image forming apparatus according to claim 1, wherein the cleaning member remains within the groove in both the paper feeding position and the cleaning position.

* * * * *